United States Patent [19]

Crivello et al.

[11] Patent Number: 4,583,731

[45] Date of Patent: Apr. 22, 1986

[54] SPINAL EXERCISING APPARATUS

[75] Inventors: James P. Crivello, 17301 NE. 131st; Redmond, Wash. 98052; Barry A. Spencer, Redmond, Wash.

[73] Assignee: James P. Crivello, Redmond, Wash.

[21] Appl. No.: 568,253

[22] Filed: Jan. 4, 1984

[51] Int. Cl.[4] ..... A61G 7/00; A61G 7/06; A63B 21/02; A63B 21/04

[52] U.S. Cl. ..... 272/144; 272/135; 272/136; 272/137; 272/141; 5/62; 5/72

[58] Field of Search ..... 272/144, 134, 135, 136, 272/94, 130, 137–142, 145; 128/25 R, 71; 297/404, 408; 5/432, 433, 434, 71, 72, 78, 62

[56] References Cited

U.S. PATENT DOCUMENTS

| | | | |
|---|---|---|---|
| 1,973,945 | 9/1934 | Chavin | 272/134 |
| 2,973,029 | 2/1961 | Schlosstein | 297/404 |
| 4,429,871 | 2/1984 | Flechner | 272/144 X |

OTHER PUBLICATIONS

Jones, Arthur—A New Approach to the Problem of Neck Injuries in Sports 1979.

Darden, Ellington—The Nautilus Bodybuilding Book ©1982 (Chapt. 25).

*Primary Examiner*—Richard J. Apley

*Assistant Examiner*—Kathleen J. D'Arrigo

[57] ABSTRACT

Spinal exercising apparatus, also referred to as a spinal exercising table, is arranged to support a person, while he or she applies forces, via his or her head, as his or her body is actively supported on an angularly adjustable table, movably positioned and then selectively secured on a frame to then be above floor level. Pivotally secured to the frame adjacent an end of the table is a resistive force mechanism to receive his or her head applied forces and to then provide a substantially uniform opposing force throughout a selected range of arcuate exercising motions, which result in a person being able to completely and thoroughly exercise his or her entire spine. Optionally, other apparatus is secured to the frame and/or table to serve the person in performing other exercises, to accomplish, if desired, a total body workout.

5 Claims, 15 Drawing Figures

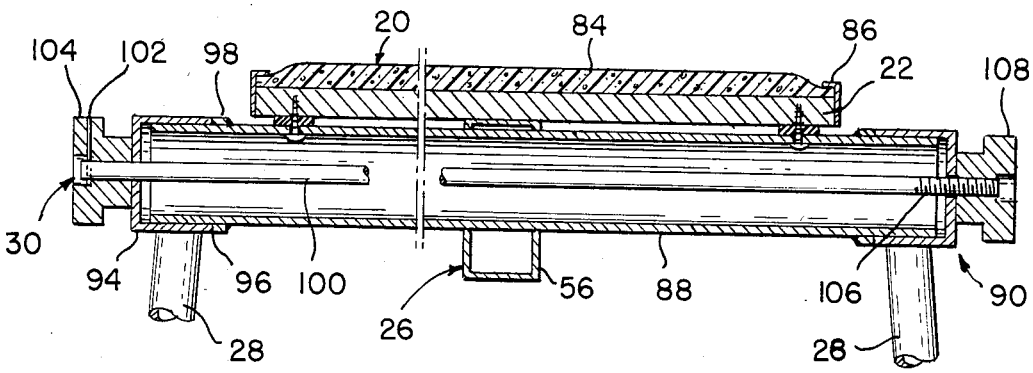
FIG. 5
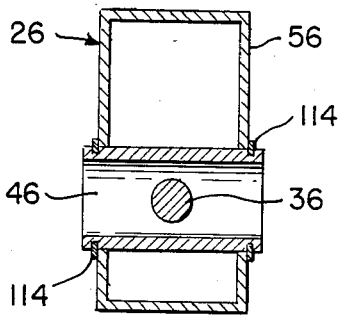
FIG. 6
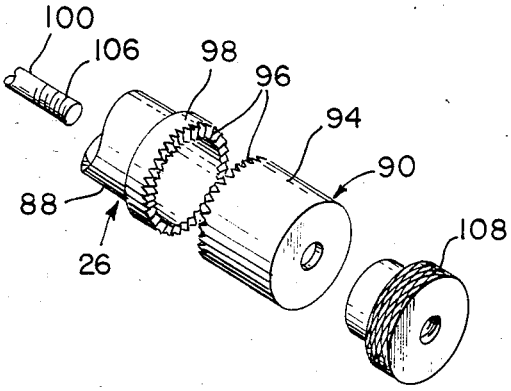
FIG. 7
FIG. 8
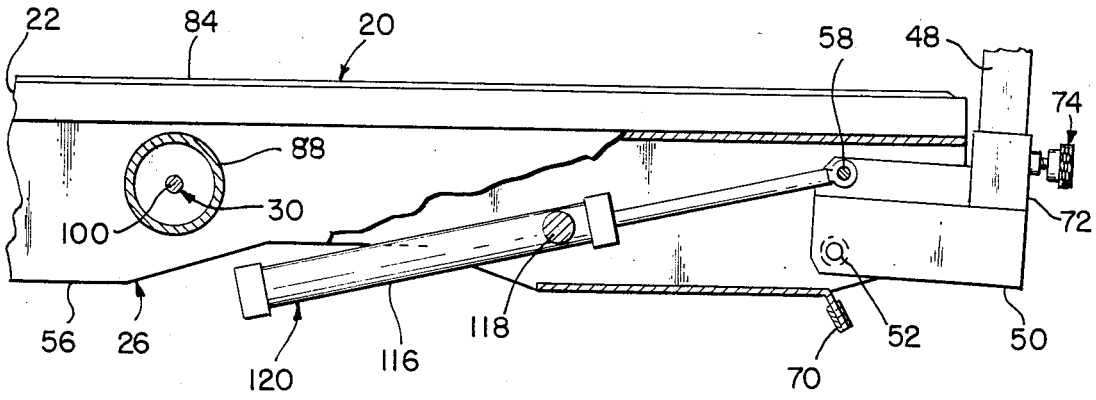

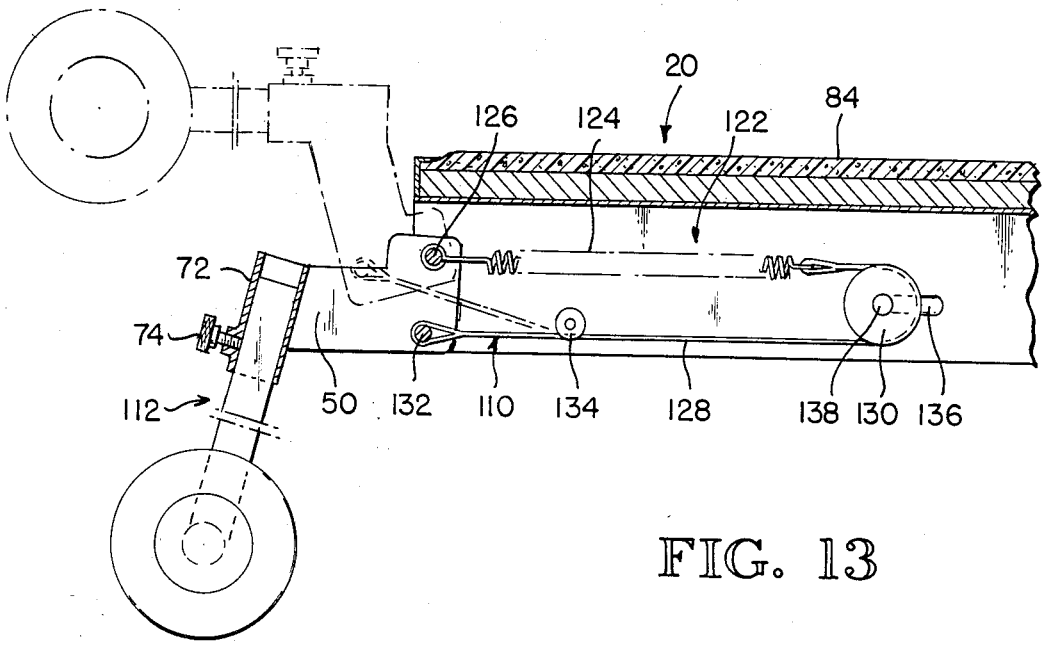
FIG. 13
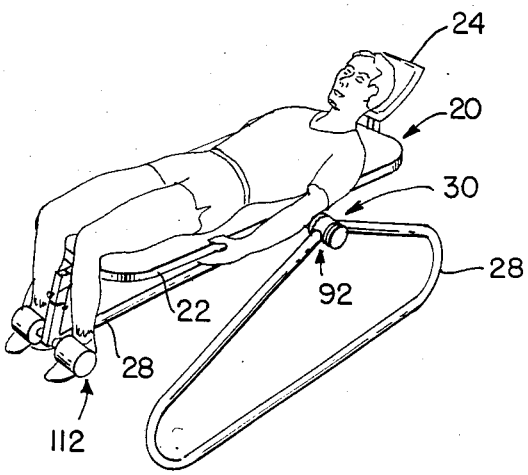
FIG. 14
FIG. 15
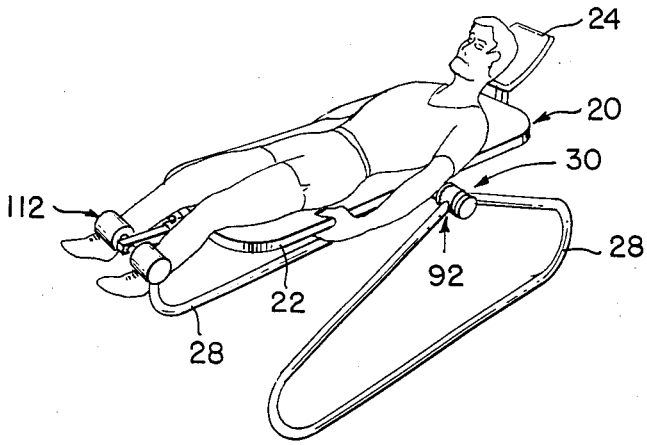

SPINAL EXERCISING APPARATUS

BACKGROUND

Today, there is no known exercising apparatus which may be used by a person to effectively and to completely exercise his or her spine via applying forces via his or her head while his or her body is actively supported on an angularly adjustable table, to which is directly or indirectly attached an adjacent resistive force mechanism to provide a substantially uniform opposing force throughout a range of motion. In respect to prior exercising apparatus provided to assist a person in exercising muscles, which exercises in turn helped in exercising one's spine, Willis G. Schockey in his U.S. Pat. No. 1,539,214, in 1925 illustrated and described a central raised horizontal support to firmly receive a person's central body portions, and spring supported extensions, pivotally secured to the central raised horizontal support, to flexibly receive a person's head, neck, shoulders, arms and legs. A person used Mr. Schockey's exercising apparatus by bending his or her arms and moving them in circular movements while his or her head rested on a spring supported extension, which was then caused to spring up and down. During this exercise a person exercised the muscles of his or her neck, shoulders, arms, chest and back. Also the person could alternately or simultaneously exercise by moving his or her feet and legs up and down on the other spring supported extension, which was then caused to spring up and down, and thereby this person also exercised the muscles of his or her legs.

Although there are many other exercising apparatus, none of those developed previously are known to be more effective than Mr. Schockey's exercising apparatus in undertaking exercises which help in improving the conditions of one's muscles and thereby improving the condition of one's spine. There remained a need for apparatus which could be used by a person to more thoroughly exercise his or her spine, via many body positions and body motions, centering on forces being applied via one's head to a resistive force, preferably with one's body being in many positions, which nullify or modify the effects of gravity on one's spine, thereby giving one's spine the opportunity to be effectively self adjusted as the smaller muscles involved in one's back movements are more effectively exercised.

SUMMARY

Spinal exercising apparatus is available for use by a person who has sustained a neck and/or back injury and who at his or her selected self applied force is able to commence and to continue exercises which effectively aid the person in their recovery. Moreover, this spinal exercising apparatus may be continually used, or used at the outset without having sustained an injury, to keep the spine in a good active structural condition and to keep all the related muscles well toned, i.e. resiliency is put back in one's back and kept in one's back. This spinal exercising apparatus, also referred to as a spinal exercising table, centers on a person applying forces via his or her head, while his or her body is actively supported on an angularly adjustable table, which is movably positioned and then selectively secured horizontally or inclined on a frame to then be above floor level. The person applies forces via his or her head to a resistive force mechanism which creates and maintains preferably a substantially uniform opposing force throughout a preselected range of arcuate exercising motions. The person so exercising following many differently undertaken positions and motions, always centering on applying forces via his or her head, is thoroughly able to completely exercise his or her entire spine. Optionally other apparatus is secured to the frame and/or table to serve the person in performing other exercises to accomplish, if desired, a total body workout.

DRAWINGS

A preferred embodiment of the spinal exercising apparatus is illustrated in the drawings, with some other optional apparatus being shown which are used in other exercises, wherein:

FIG. 1 is a perspective view of the spinal exercising apparatus which is also called a spinal exercising table;

FIG. 2 indicates how a person uses the spinal exercising table or apparatus while in a supine position, which is one position of many to be selected by the exercising person, when he or she is applying a force, via his or her head, to a head rest of a mechanism, which is secured to a main frame of the spinal exercising table;

FIG. 5 is a partial cross sectional view taken along the middle of the transverse member of the main frame, particularly indicating the adjustment subassembly utilized, when it is tightened, to hold the table and its main frame at respectively selected angular or horizontal positions with respect to the side frame of this spinal exercising apparatus;

FIG. 6 is an enlarged partial view showing how a transverse barrel sleeve is rotatably positioned on the longitudinal main frame to slidably position and to guide a control rod of a resistive force mechanism;

FIG. 7 is a perspective partial exploded view of the components located at one end of the adjustment subassembly, which is illustrated in FIG. 5, indicating the use of a crown coupling;

FIG. 8 is a partial longitudinal elevational view, with some portions being broken away for illustrative purposes to illustrate how a fluid actuator might be used in place of the spring actuator shown in FIG. 4;

Figure 9:
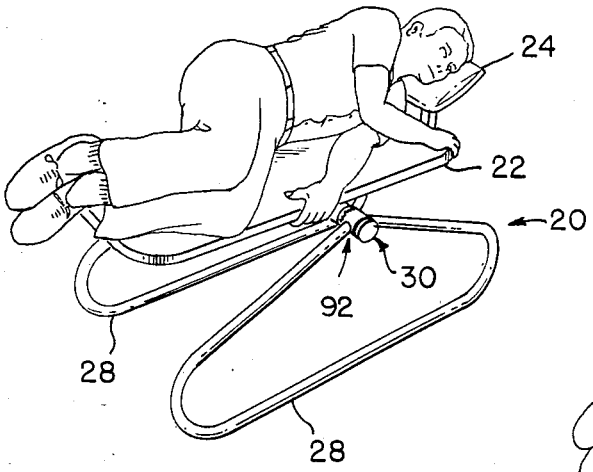
Figure 10:
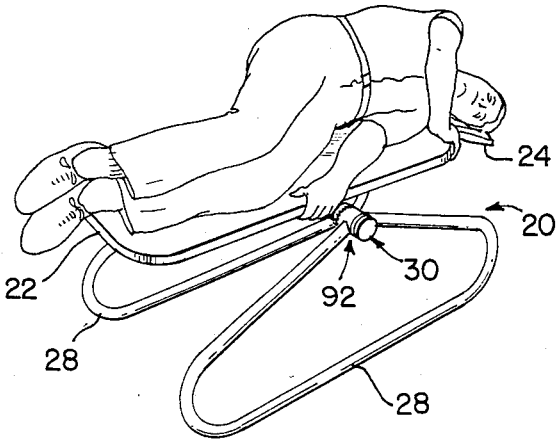
Figure 11:
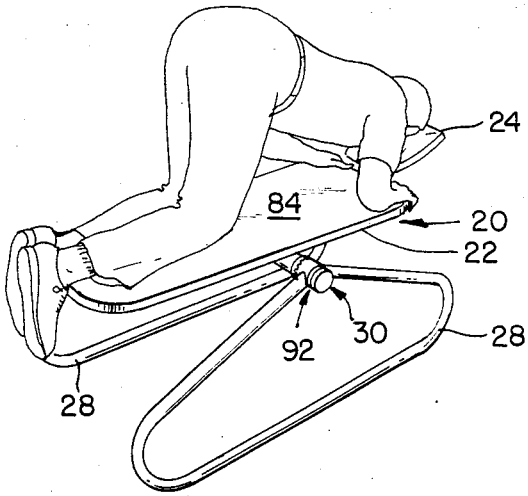
Figure 12:
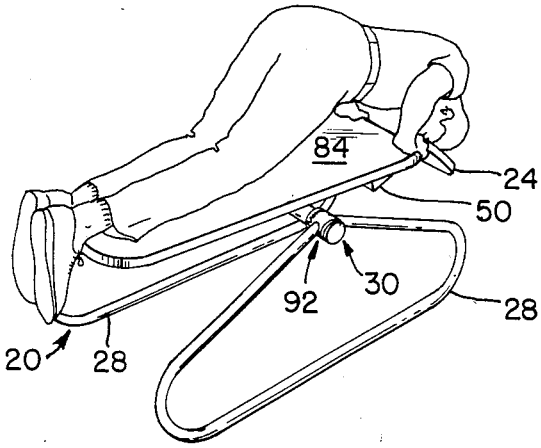

FIGS. 9, 10, 11, and 12 illustrate two more general positions of a person who is exercising by using this spinal exercising apparatus, with the person being on his right side in FIGS. 9 and 10, as he forces the head rest, etc. arcuately downwardly against the substantially constant resistive force of the mechanism secured to the main frame; and with the person being faced downwardly in FIGS. 11 and 12, as he also forces the head rest, etc. arcuately downwardly, and in so doing raises and lowers his mid body position;

FIGS. 13, 14, and 15 illustrate how the spinal exercising apparatus is optionally equipped at an end, opposite to the end supporting the head rest, with an accessory to uniformly resist the upwardly arcuate motion of a person's feet and lower legs, which also exercises the person's spine.

DESCRIPTION OF THE PREFERRED EMBODIMENT

Why and How the Spinal Exercising Apparatus is Used

The preferred embodiment of the spinal exercising apparatus 20 illustrated in the drawings is principally utilized by persons, often patients, who have experienced stress or strain particularly in the neck region of their spine, in accidents, such as an automobile rear end collision. Whatever the cause or just the need for good exercise, a person is able to use this spinal exercising apparatus 20, often referred to as a spinal exercising table 20, at his or her own discretion, as to the forces and motions to be undertaken in respect to his or her own understanding of how badly they may be suffering and later of how well they may be improving. In respect to severe injuries, medical professionals will be relied upon with respect to a person's use of this spinal exercising apparatus 20.

Figure 1:
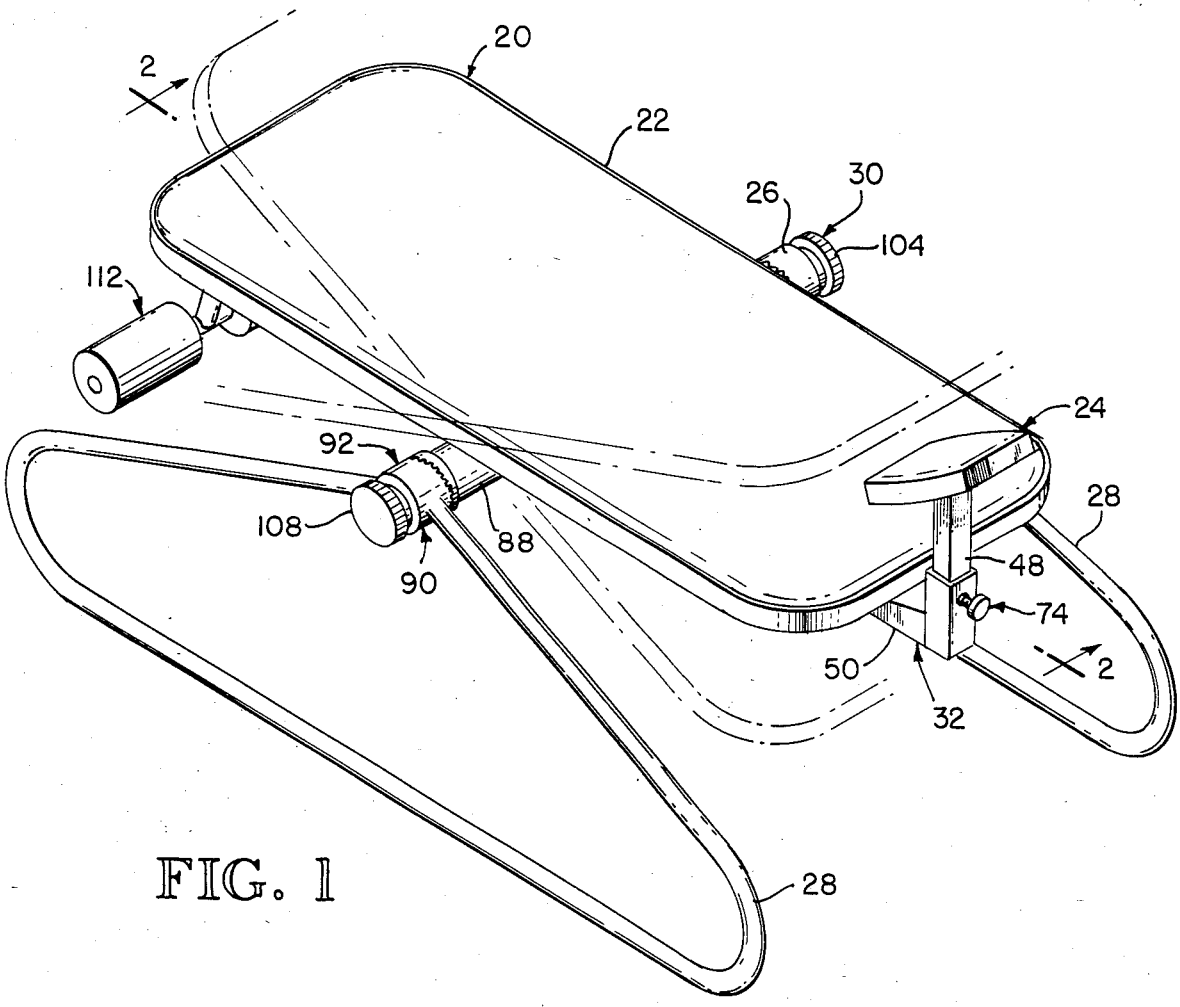
Figure 2:
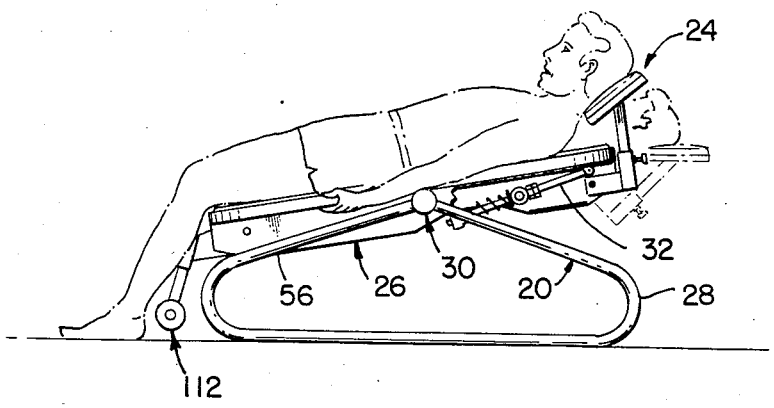

In FIGS. 1 and 2 the arrangement and use of the spinal exercising apparatus 20 are illustrated. In respect to a neck strain, one of the first exercises to be at first tenderly undertaken involves lying on one's back on the table 22 with one's head supported on the head rest 24. The table 22 may be set in an angular position of about ten degrees as the table frame 26 is rotated and then secured to the respective side frames 28, using the transverse tensioning assembly 30. The person then applies pressure with the back of his or her head to the head rest 24, which deflects in an arcuate path while providing a substantially uniform resistive force. As persons are able to complete cycles of such head applied forces, they realize they are experiencing better health throughout their spine and the related other body portions such as their muscles. They may adjust the table 22 into a level position or tilt the table ten degrees in the opposite direction to gain better corrective reactive movements in their respective spines. As they progress in their conditioning they will seek other positions and other motions such as shown in FIGS. 9 and 10, where the person is lying on one side or the other, or as shown in FIGS. 11 and 12, where the person is lying with his or her face adjacent the head rest 24.

Preferred Substantially Constant Resistive or Reactive Force

Figure 3:
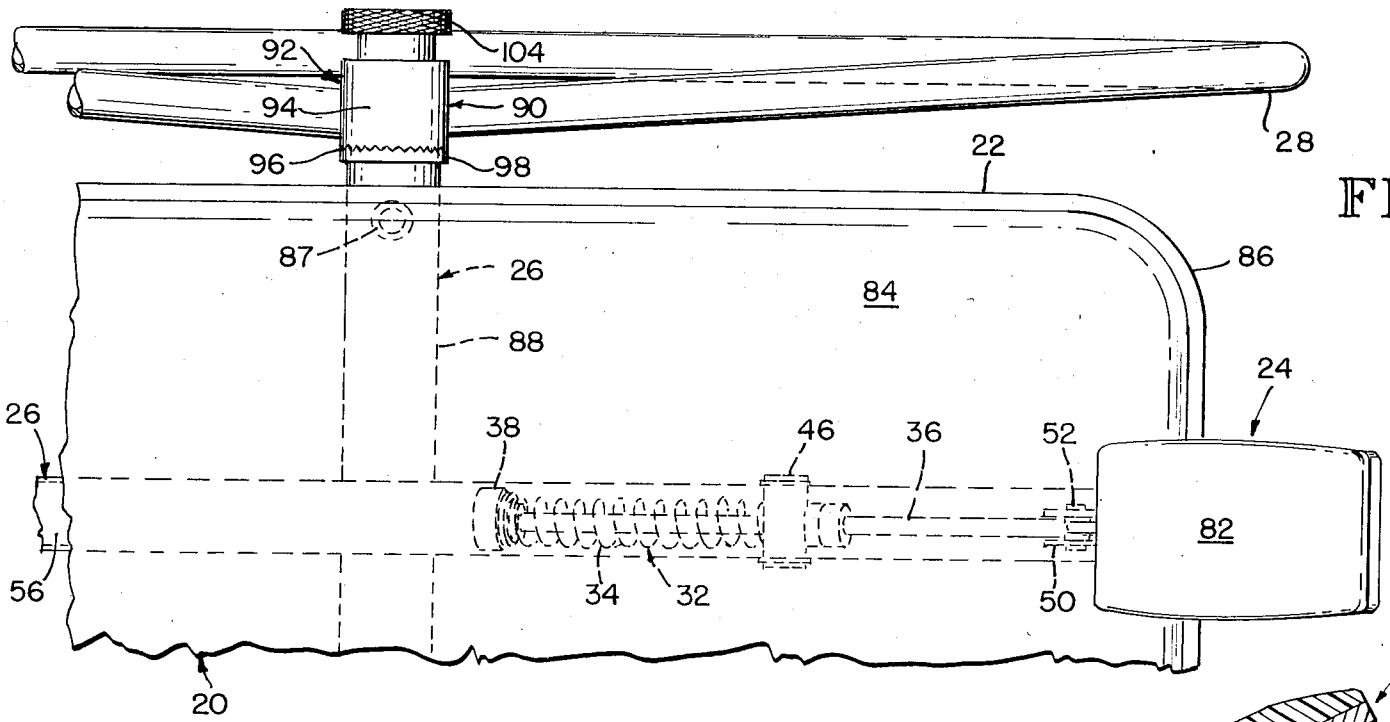
FIG. 3 is a partial top view of the spinal exercising apparatus shown in FIGS. 1 and 2.
Figure 4:
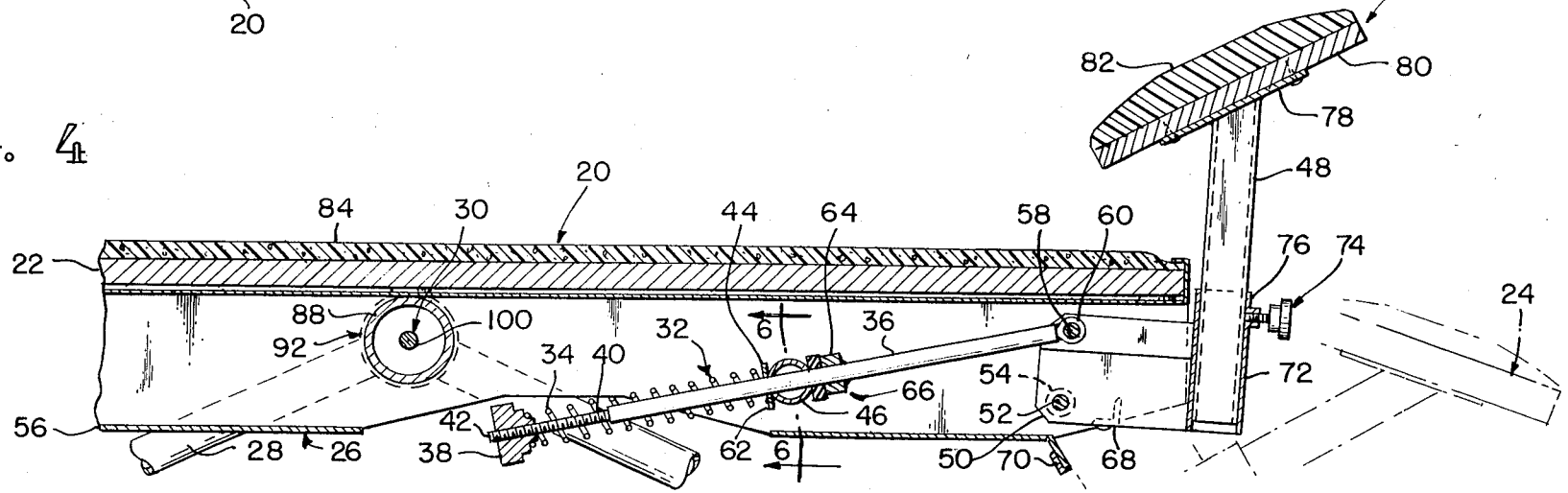
FIG. 4 is a partial longitudinal elevational view of the spinal exercising apparatus, shown in FIGS. 1, 2, and 3, with some portions being broken away for illustrative purposes, and with dotted lines indicating the arcuate movement of the head rest, the head stem, and the yoke.

The spinal exercising apparatus 20 has a resistive or reactive force creating assembly 32, which preferably provides throughout an arcuate range of motion a substantially constant or uniform resistive or reactive force. Other motions and different variations of forces are possible, but not deemed as being as beneficial in aiding the person or patient who is exercising, by utilizing the spinal exercising apparatus 20. In FIGS. 3 and 4, the preferred embodiment of the reactive force creating assembly 32 is illustrated. The power source of the reactive force is a coiled spring 34 centered about a control rod 36. A hand knob 38 is selectively turned along threads 40 of the lower end 42 of the control rod 36 and abuts the coiled spring 34 to increase or decrease the effectiveness of the coiled spring 34 in creating the resistive force reaching the exercising person at the head rest 24. The other end of the coiled spring 34 abuts a washer 44 which in turn abuts a barrel sleeve 46 that is firmly secured to the table frame 26.

After adjustment of the hand knob 38, the then effective length of the coiled spring 34 is compressed upon movement of the resistive force assembly 32, which is initiated as a person, using his head, bears down on the head rest 24. The person's created force is carried or resisted via the head stem 48, supporting the head rest 24, to a yoke 50, which is pivotally mounted, via a pivot pin 52 and pivot bushing 54, to the central longitudinal beam 56 of the table frame 26.

Spaced away from this pivot pin 52 location on the yoke 50, the upwardly extending end of the control rod 36 is pivotally connected to the yoke 50, by using a roll pin 58 secured to the yoke 50 and surrounded by a cylindrical bearing with its housing 60 in turn secured to this end of the control rod 36. When the head rest 24 is moved, the resulting pivoting of the yoke 50, pulls the control rod 36 through aligned clearance openings 62, 64 on the barrel sleeve 46. Such movement compresses the coiled spring 34 increasing its resistive force. However, the effective torque arm represented by the distance on the yoke 50 between the pivot pin 52 and the roll pin 58 decreases, so the increasing spring resistive force is sufficiently compensated or offset by the decreasing torque arm. As a consequence the person exercising feels the overall resistive force as being an overall constant resistive force.

The at rest travel limit of the arcuate movement of the head rest 24, is controlled at its top position by the combined rubber and metal stop 66 secured to the control rod 36 on the higher side of the barrel sleeve 46 to stop the upward return of the head rest 24, when this rubber and metal stop 66 bears against the barrel sleeve 46. The action travel limit of the arcuate movement of the head rest 24 is controlled at its bottom position as the grommet stop 68 on the yoke 50 contacts the limit pad 70 on the central longitudinal beam 56.

The head rest 24 is selectively positioned in respect to both its starting height and effective torque arm, by having the head stem 48 telescoped into an integral receiver 72 on the yoke 50. It is then held in a selected position by turning the hand knob 74, which has an integral set screw passing through a hole 76 in the receiver 72 to bear against the inserted portion of the head stem 48.

The head stem 48 has a top plate 78 arranged on a bias to support a head rest base 80, which in turn has a padded cover 82 to complete the resistive force assembly which is moved by a person applying a force via his or her head.

Adjustable Support for the Body of the Exerciser

As shown in FIGS. 2 and 9 through 12, when a person is applying his or her force to the resistive force assembly 32, his or her body is preferably supported on a table 22, which in turn is adjustably supported above floor level using the table frame 26 and side frames 28. The table 22 substantially supports one's body from shoulders to thighs essentially throughout the width of one's body. A padded cover 84 is installed, using edge trim 86, over the entire top of the table 22, which is made of a strong material.

As particularly illustrated in FIGS. 3 and 4, the table 22 has its own supporting table frame 26, having a central longitudinal beam 56, and a centered transverse hollow cylinder 88, which are secured together and to the table 22, using some selected securement fasteners, not shown, and by welding, etc.

To provide room for angularly tilting the table 22, the side frames 28 are used in pivotally mounting the table 22 well above floor level. In this illustrated embodiment a respective crown coupling assembly 90 is used in the pivotal supporting of each of the respective ends of the centered transverse hollow cylinder 88 on the central high location 92 of the respective side frames 28. A respective cap end crown portion 94 is secured to each side frame 28, with the interfitting crown projections 96 facing the center of the table 22. A respective circumferential ring crown portion 98, with like interfitting crown projections 96 which are oppositely directed, is firmly secured near each end of the centered transverse hollow cylinder 88, while still leaving clearance from the respective ends of this hollow cylinder 88 to be inserted into the respective cap end crown portions 94 on the respective side frames 28.

To hold the crown coupling assembly 90 together at a selected level or angular positioning of the table 22 relative to the side frames 28, to keep the table's preselected position during one's exercising, a transverse tensioning assembly 30 is used, as particularly illustrated in FIGS. 5 and 7. A tension rod 100 is centrally positioned throughout the center transverse cylinder 88 of the table frame 26 and it passes on through and beyond the respective crown coupling assemblies 90. At one extended end 102, the tension rod 100 is roll pin secured to a hand knob 104, and at its other extended and threaded end 106, the tension rod 100 is threadably secured to another hand knob 108.

When one hand knob is held and the other hand knob is turned, the transverse tensioning assembly 30 is either tightened to firmly interfit the crown projections 96 and keep the table 22 in a selected position as shown in FIG. 5, or as indicated in FIG. 7, the crown projections 96 are separable, when the hand knobs 104, 108 are turned in the oppositive rotative direction. When the crown projections 96 are separated, the table 22 with its table frame 26 is then pivotally moved to a new selected position relative to the side frames 28, and thereafter tightened into place once again, as the hand knobs 104, 108 are rotated in their opposite relative direction.

Other Accessories to Increase the Range and Type of Exercises

In FIGS. 13, 14, 15, a second resistive force assembly 110 is illustrated which serves to be moved by a person using his or her feet to apply the exercising force, as one's head still bears on the head rest 24, also selectively causing its movement. The torque arm position and rotational direction are both opposite to those associated with the resistive force assembly 32 which is moved by one's head applying the exercising force. All the components, except for the foot rests assembly 112, could be the same as those used in the other resistive force assembly 32. However, both at this foot rest assembly 112 location and at the head rest location, another resistive force mechanism 122 is optionally used, as shown in FIG. 13, a coil spring 124 is arranged between the center of rotation pin 126 and a cable 128, which is passed around a pulley 130 and returned for attachment to the pin 132 on the yoke, which moves in an arcuate path around the center of rotation pin 126, as shown in FIG. 13. A small pulley 134 is positioned to guide the cable 128 during its deflection as the yoke 50 pivots. The effective force of this resistive force mechanism 122 is changed by moving the pulley 130 to selected locations along the elongated slot 136, through which the shaft 138 of the pulley 130 is selectively positioned, and then secured by a fastener, not shown.

Although coiled springs 34, of interchangeable sizes and/or strength, or of adjustable effective lengths, are preferred for resisting these foot and/or neck applied exercising forces, other sources of resistive forces could be used. For example, as shown in FIG. 8, a fluid cylinder 116 could be used and mounted on a shaft 118, in turn mounted on the central longitudinal beam 56 of the table frame 26. The other components of this fluid resistive force assembly 120 are similar to those of the other resistive force assemblies 30, 110.

Many Exercises are Performed Using This Spinal Exercising Apparatus

The preferable starting exercise of a person and/or patient who has pain in his or her neck and/or somewhat lower in his or her back, is illustrated in FIG. 2. For example persons who are suffering from pain caused by whip lash of their necks which occurred in an automobile accident, assuming X-rays do not now reveal more serious injuries, may be instructed to commence exercises on this spinal exercising apparatus 20, i.e. spinal exercising table 20, very carefully, slowly, at low force creating levels. As they themselves analyze their improvement, they may extend the exercise cycles and/or periods, with restful interludes, and eventually increase their applied forces.

When the pain threshold has been lowered, persons may increase their applied forces and/or increase their complete body muscular participation. For example, still in the supine position they may place their feet on the table 22 and raise their central portions of their body up and down, as they apply and withdraw their application of a force, via their head, to the head rest 24 and the resistive force assembly 32. During these supine exercises, the angularity of the table 22 relative to the side frames 28 may be changed. When the table 28 is level and/or tilted downwardly, the gravity forces on one's spine, normally experienced when a person is standing, are withdrawn and/or reversed, thereby creating a greater opportunity for each vertebra to adjust itself with respect to its adjacent vertebrae, as the person is exercising on this spinal exercising apparatus 20.

In FIGS. 9 and 10, a person is shown lying on his side on table 22, while using his head to apply exercising forces, via the head rest 24, to the resistive force assembly 32. In FIGS. 11 and 12, a person is shown kneeling, face down, on table 22, while applying exercising forces, using his head, to the head rest 24 and consequently to the resistive force assembly 32. In this exercise, the person is instructed to tuck his or her chin in at the outset of applying his or her force, and to actively raise and lower the central portions of his or her body.

These exercises, centering on the application of exercising forces, using one's neck, via the head rest 24, to the resistive force assembly 32, are expanded in their overall effectiveness, as a person's ability to apply force improves, and they simultaneously exercise other portions of their entire body. In so doing many of the smaller muscles associated with the many vertebrae are exercised so thoroughly they become strengthened. When these muscles and all other related muscles become thoroughly exercised and strengthened, then the spinal adjustments which are needed are beneficially fostered, undertaken, and maintained more readily, and the person and/or patient enjoys better health.

During these exercises, or separately, other exercises, may be undertaken, as shown in FIGS. 14 and 15, when a person also applies forces with his or her feet using the foot rest assembly 112 and the foot resistive force assembly 110. As shown in FIGS. 2, 9 through 12, and 14 and 15, the person exercising uses his hands to grip the edges of the table 22. He or she may also use his or her hands or feet to grip portions of side frames, and/or the ends of the central longitudinal beam 56 of the table frame 26. Although not shown, specific hand grips could be installed. Also other changes could be made such as adding hand operated cam assemblies in lieu of the hand knobs 104, 108 and crown coupling assemblies 90, which would serve to receive the hands during exercising and also to receive the hands in applying cam tightening and loosening forces, during angular changes of the table 22 relative to the side frames.

Those persons, after recovering from their initial neck and/or back pain illnesses, who realize the spinal exercising apparatus 20, may be used as the basis of undertaking other exercises, use it for the foot exercises, shown in FIGS. 14 and 15, and several other exercises. Some of them obtain some of the effects of an inversion table. Others tip the entire apparatus 20 on end, and then using their arms raise and lower their bodies. Others combine the apparatus 20 with other exercising weights.

Whatever additional exercises are found to be possible, the principal basic exercising purpose centers on applying exercising forces with one's head, while supported on the table 22 of the spinal exercising apparatus 20, which are received, via the head rest 24, and resisted, via the resistive force assembly 32. Such application of exercising forces substantially benefits the person by putting resiliency back into one's back and keeping it there. His or her spine is loaded and unloaded during these exercises under his or her controlled limits of stress, and all one's body portions, large, medium, and small, such as the bones, muscles, ligaments, and cartilages, etc., are involved and stimulated with many of the other body functions of blood flow, breathing, etc., to return persons to good health and to keep them in good health.

We claim:

1. Spinal exercising apparatus centering on a person, while on a table, applying forces via contact of his or her head, on a head pad assembly having a uniformly resistive force means, when the head pad is initially located above the end of the table, and as the person continues to apply his or her force, the head pad assembly is rotated downwardly below the end of the table, while continuously applying a uniformly resistive force, comprising:

(a) a table of a width and length to support a person from his or her knees to his or her neck, having a supporting frame to position the table above floor level, the table being substantially planar and having first and second ends; and (b) a head pad assembly having a uniformly resistive force means, pivotally secured to the underside of the first end of the table, to initially position the head pad above the table for receiving a person's head, to rotate downwardly below the first end of the table when a person continuously applies forces against uniformly resistive force means.

2. Spinal exercising apparatus, as claimed in claim 1, wherein the supporting frame has a top center transverse shaft to receive the table at its center, and an adjusting and locking means to rotate the shaft to selected angles, thereby positioning the table at respective angles relative to floor level, so a person's body is optionally positioned at respective angles, as he or she is applying forces via his or her head.

3. Spinal exercising apparatus, as claimed in claims 1 or 2, wherein the uniformly resistive force means pivotally secured to the underside end of the table has a resistance spring subassembly secured to the underside end of the table, and has pivotal frame supporting head pad, which also pivotally receives the resistance spring subassembly at a torque arm distance away on the pivotal frame from the place of pivoting of the pivotal frame.

4. Spinal exercising apparatus, as claimed in claim 1, wherein the head pad assembly is adjustable, whereby the head pad is selectably placed at various heights above the table before receiving forces to be applied by a person using his or her head.

5. A method of providing reactive and resistive forces to a person when he or she are exercising his or her spine, comprising:

(a) providing a table support for a person's body above floor level having the width of a person's body and the length from a person's knees to his or her neck, the table being planar and having first and second ends;

(b) providing a head pad assembly pivotally secured to the underside of the first end of the table support to initially position a head pad above the table for receiving a person's head; and (c) providing a uniformly resistive force means to react to the downward pivotal movement of the head pad, as a person moves the head pad arcuately and downwardly, below the table support via his or her head, and in so doing, the person on the table, while holding on to the table, is exercising his or her spine in applying the forces by his or her head.

* * * * *